US009808733B2

(12) United States Patent
Lambert

(10) Patent No.: US 9,808,733 B2
(45) Date of Patent: Nov. 7, 2017

(54) ASSEMBLY OF CONSTRUCTION ELEMENTS AND METHOD OF CONNECTING CONSTRUCTION ELEMENTS

(71) Applicant: Toran NV, Roeselare (BE)

(72) Inventor: Marc Lambert, Ardooie (BE)

(73) Assignee: Toran NV, Roeselare (BE)

( * ) Notice: Subject to any disclaimer, the term of this patent is extended or adjusted under 35 U.S.C. 154(b) by 0 days.

(21) Appl. No.: 15/037,688

(22) PCT Filed: Nov. 21, 2014

(86) PCT No.: PCT/IB2014/066234
§ 371 (c)(1),
(2) Date: May 19, 2016

(87) PCT Pub. No.: WO2015/075681
PCT Pub. Date: May 28, 2015

(65) Prior Publication Data

US 2016/0288009 A1 Oct. 6, 2016

(30) Foreign Application Priority Data

Nov. 21, 2013 (BE) ..... 2013/0785

(51) Int. Cl.

| | |
|---|---|
| ***A63H 33/04*** | (2006.01) |
| ***A63H 33/08*** | (2006.01) |
| ***A63H 33/10*** | (2006.01) |
| ***E04B 2/08*** | (2006.01) |
| ***A47B 47/04*** | (2006.01) |
| ***A47F 5/10*** | (2006.01) |
| *E04B 2/02* | (2006.01) |

(52) U.S. Cl.
CPC ..... *A63H 33/082* (2013.01); *A47B 47/04* (2013.01); *A47F 5/10* (2013.01); *A63H 33/105* (2013.01); *E04B 2/08* (2013.01); *E04B 2002/0252* (2013.01)

(58) Field of Classification Search
CPC ..... A63H 33/082; A63H 33/84; A63H 33/105
USPC ..... 446/85, 122, 124, 125, 127
See application file for complete search history.

(56) References Cited

U.S. PATENT DOCUMENTS 1,985,992 A * 1/1935 Hayman ..... A63H 33/105 376/459
2,225,612 A * 12/1940 Allen ..... E04F 15/04 376/459

(Continued)

FOREIGN PATENT DOCUMENTS

DE 2903844 A1 8/1980
DE 19845160 A1 4/2000

(Continued)

*Primary Examiner* — Alexander Niconovich
(74) *Attorney, Agent, or Firm* — James Creighton Wray; Meera P. Narasimhan

(57) ABSTRACT

Assembly of two construction elements (1) which each comprise a number of side faces and are provided with a connecting means (2) for connecting the construction elements (1) to one another. The construction elements each comprise a side face with a recess (3), the recess (3) having been produced by cutting away a part (4) from the construction element (1). The slidable parts (4) are slidable in the recesses (3) and form the connections (2). A method of connecting such construction elements (1) to one another is also provided.

15 Claims, 5 Drawing Sheets

(56) References Cited

U.S. PATENT DOCUMENTS 2,392,551 A * 1/1946 Roe ..... E04B 2/08 52/309.17
2,735,146 A * 2/1956 Purviance ..... A63H 33/105 376/459
3,160,249 A * 12/1964 Pavlecka ..... B62D 27/06 24/30.5 S
3,576,936 A * 5/1971 Fischer ..... A63H 33/042 434/224
4,035,977 A * 7/1977 Fischer ..... A63H 33/082 446/125
4,052,832 A * 10/1977 Jungers ..... E04B 1/32 52/586.1
4,171,591 A * 10/1979 Fischer ..... A63H 33/105 446/127
5,653,621 A * 8/1997 Yao ..... A63H 33/082 446/127
5,954,562 A * 9/1999 Chen ..... A63H 33/10 446/103
5,957,744 A * 9/1999 Mott ..... A63H 33/105 446/122
6,189,282 B1 * 2/2001 VanderWerf ..... E04B 2/14 52/582.1
8,147,162 B1 * 4/2012 Burnett ..... F16B 5/0052 312/263
8,435,095 B1 * 5/2013 Abbas ..... A63H 33/105 446/122
8,568,187 B2 * 10/2013 Norman ..... A63H 33/084 273/156
8,671,640 B1 * 3/2014 Thomas ..... E04B 2/18 446/122
9,016,668 B1 * 4/2015 Christensen ..... E04H 17/16 256/13.1
9,033,761 B2 * 5/2015 Azmani ..... A63H 33/105 446/122

FOREIGN PATENT DOCUMENTS

GB 1534501 A 12/1978
GB 2224953 A 5/1990
WO 2008000861 A1 1/2008

* cited by examiner

ASSEMBLY OF CONSTRUCTION ELEMENTS AND METHOD OF CONNECTING CONSTRUCTION ELEMENTS

This application claims the benefit of Belgian Application No. 2013/0785 filed Nov. 21, 2013, and PCT/DK filed Nov. 21, 2014, International Publication No. WO 2015/075681 A1, which are hereby incorporated by reference in their entirety as if fully set forth herein.

The present invention relates to, on the one hand, an assembly of at least two construction elements which each comprise a number of side faces and are provided with at least one connecting means for connecting the construction elements to one another.

On the other hand, the present invention relates to a method of connecting at least two construction elements which each comprise a number of side faces.

Construction elements which comprise a number of side faces are known. Examples of such elements are, for example, block-shaped elements, toy building blocks, insulation material, components of a stand, block-shaped components of racks and wall and floor elements. The present invention can thus be applied in various sectors, such as the toy industry, stand construction, furniture, insulation of dwellings, wall cladding, etc.

Two construction elements can be connected to one another in different ways. Often, use is made of a specific connecting means in order to connect both construction elements to one another.

Thus, U.S. Pat. No. 5,954,562 describes a toy in which the toy comprises construction elements which can be connected to one another via a connecting means. The construction elements are each provided with grooves into which a connecting means can be fitted. Two construction elements are connected to one another by fitting an identical connecting means in the grooves of two construction elements. The shape of the connecting means is adapted to the shape of the grooves. Thus, the connecting means are elongate bodies having an X-shaped cross section and the grooves have an X-shaped cross section.

DE 19845160 describes mutually fitting construction elements, in particular building blocks which can be connected to one another by means of a connecting means. The building blocks are provided with grooves having an isosceles trapezoid cross section and the connecting means is a connecting body having an X-shaped cross section. In order to be able to produce the connection between two building blocks, firstly the two building blocks are positioned against one another in such a way that the grooves come to lie opposite one another and subsequently the connecting body is fitted in both grooves. In that case, one half of the connecting body is situated in one building block and the other half of the connecting body is situated in the other building block, as a result of which the building blocks are connected to one another.

GB 2224953 describes construction elements, toy building blocks which are connectable to one another by means of a connecting means. The toy building blocks comprise grooves having an isosceles trapezoid cross section. To connect two or more toy building blocks to one another, the construction elements are positioned against one another in such a way that the grooves come to lie opposite one another and the connecting means is pushed into both grooves. The connecting means has a cross section of two isosceles trapeziums, as a result of which it fits into the grooves adjoining one another.

The drawback of all these existing assemblies of construction elements and connecting means is that the connecting means take up some volume and that it is impossible to stack the connecting means together with the construction elements in a compact manner. The costs of packaging, storage and transportation depend inter alia on the volume. It is therefore desirable for the construction elements and the connecting means together to take up as little volume as possible.

An additional drawback is that fact that, when a channel/groove of a construction element is not used to produce a connection with another construction element, this channel/groove remains visible. This is undesirable from an aesthetic point of view. In addition, such an open channel/groove is prone to accumulation of dust. If it is still desired to use the channel/groove at a later point in time to produce a connection, the accumulation of dust makes it difficult to produce this connection.

It is therefore an object of the invention to provide an assembly of at least two construction elements and a connecting means which does not have the abovementioned drawbacks and to also provide a method of connecting at least two construction elements which does not have the abovementioned drawbacks.

This object is achieved by providing an assembly of at least two construction elements which each comprise a number of side faces and are provided with at least one connecting means for connecting the construction elements to one another, in which at least one side face of each construction element comprises a recess and a part which is slidable in said recess and whose shape is virtually identical to the shape of the recess, and in which said connecting means is formed by the slidable parts of two different side faces.

The recess may, for example, be the result of a cutout which is made in the side face after the construction element has been produced. However, the recess may also be formed during the production process of the construction element, for example during casting of the construction element or during extrusion of the construction element. The construction elements may be made of plastic, wood, concrete, etc.

During packing, these slidable parts do not take up additional volume as the slidable part has substantially the same shape as the shape of the recess and therefore fits into the recess virtually completely. As a result thereof, compact stacking of the construction elements and their connecting means is possible. Due to the fact that the connecting means forms part of the assembly according to the invention, as it were, it is no longer necessary to provide a separate storage space for a connection element which might at some stage be required, since it is always present in case it is required.

If a recess of a construction element is not used to produce a connection with another construction element, the recess can be filled with the slidable part. As a result thereof, the recess is no longer visible and no longer prone to dust accumulation. Therefore, dust is no longer a problem, if the recess is to be used again after some time to produce a connection with another construction element. With packaged or stored construction elements, it is thus always possible to ensure that each recess is filled with a slidable part in such a way that dust is not a problem.

At least one of said side faces of both construction elements comprises one recess, but said side face may also be provided with several recesses. Two construction elements can thus be connectable to one another via more than one connecting means. This benefits the strength of the connection. It is also possible for several side faces of a construction element to comprise recesses so that a construction element is connectable to two or more construction elements.

In a highly preferred embodiment, the recess is formed by cutting away a part from said construction element and said cut-out part then forms the slidable part.

Another drawback with the existing assemblies described in U.S. Pat. No. 5,954,562, DE 19845160 and GB 2224953 is the fact that the shape of the grooves/channels and the shape of the connecting means have to be accurately matched to one another. Minimal deviations in said shapes may cause the connecting means to no longer be fittable in the grooves/channels or may result in the connection between the construction elements being easily severed.

In this preferred embodiment, two construction elements are connectable to one another by fitting the cut-out parts, the slidable parts, into recesses of the mutually opposite construction elements. In this case, the connecting means is formed by the construction elements to be connected, i.e. the cut-out parts. These cut-out parts may either be used in their entirety to form the connection means or they may be used almost in their entirety to form the connecting means. There is thus no risk of the slidable parts not fitting into the recesses and not being fittable therein. The connecting means will thus not take up any greater volume than the recesses into which they have to be fitted in order to produce the connection between the construction elements. In addition, there is also no need for additional elements to connect the construction elements, as a result of which the costs of materials are lower. Also, when packing, these cut-out parts do not take up additional volume as a part cut-out from a side face will obviously fit completely into the recess from which it has been cut, thus making compact stacking of the construction elements and their connecting means possible. All known ways of removing material may be taken into consideration in order to cut out the parts from the construction elements.

In a preferred embodiment, one said recess ends in a side face, adjoining the side face which comprises said recess. In this way, the connecting means is laterally slidable into the mutually opposite recesses of the construction elements to be connected and/or the construction element can be slid around the connecting means. In particular if the construction element is made from a non-flexible material, it is important that the connection means is laterally slidable into the recesses.

Furthermore preferably, the recess extends over the entire height of the side face. This means that both ends of the side face end in a side face of the construction element. The connecting means is then laterally slidable into a recess along both ends of the recess. If one end of the recess is slightly less accessible, for example due to this end being situated opposite a wall, the other end of the recess can then be used to produce the connection between the construction elements.

In a preferred embodiment, the recesses comprise indentations with which the connecting means engages. Due to the fact that the recesses comprise indentations and the connecting means engages in these indentations when the construction elements are connected to one another, the connected construction elements are more strongly connected to one another.

In the connected position of the construction elements, the recesses of the connected side faces of the construction elements are preferably mutually opposite and each slidable part preferably extends in the recesses of the connected side faces. Both slidable parts are then situated in both construction elements, so that each slidable part contributes to a good connection of the two construction elements. As a result thereof, a strong connection between the construction elements is achieved.

Furthermore preferably, each recess is substantially symmetrical with respect to an axis which extends at right angles to the side face in which said recess is situated and, in the connected position of the construction elements, the mutually opposite recesses are virtually each other's mirror image. The space formed by the mutually opposite recesses of the construction elements to be connected thus has at least two planes of symmetry which extend at right angles to one another, i.e. the first plane of symmetry which is formed by the separation between the two recesses and a second plane of symmetry which extends at right angles to the first plane of symmetry.

The slidable parts have virtually the same shape as the recess, as a result of which they fit completely into the recess. As a result thereof, the connecting means also has two axes of symmetry which extend at right angles to one another. As a result of the symmetry of said space and the connecting means, the slidable parts, when they extend at right angles to the position they have when they are completely in their recess, will also fit completely into the space formed by the recesses. Due to the fact that the slidable parts which form the connecting means fit completely into said space, the connection between the construction elements is a strong connection. In this case, there is no risk of the shape of the connecting means not corresponding to the shape of the recess.

The ends of the slidable parts may optionally be trimmed slightly in order, for example, to facilitate sliding of the slidable parts when bringing about the connection. If several side faces of one construction element comprise recesses, trimming the ends of the slidable parts ensures that the ends of adjacent slidable parts can engage with one another when said construction element is connected to several construction elements.

When the recess is formed by cutting away a part from said construction element and when this cut-out part forms the slidable part, then the entire cut-out parts are preferably used to form the connecting means. This makes it possible to produce a connection which is as secure as possible in order to prevent sliding and displacement of the connected construction elements.

Still more preferably, the slidable parts have a dovetail-shaped cross section. The corresponding recess then also has a dovetail-shaped cross section which is virtually symmetrical with respect to an axis which extends at right angles to the side face in which said recess is situated. As a result of the dovetail-shaped cross section, a slidable part has two sharp corner parts and the corresponding recess has two indentations. This means that the connecting means, i.e. the two slidable parts, will engage in these indentations to bring about the connection between the construction elements. In the connected position of the construction elements, in which at least two recesses are mutually opposite, the position of each slidable part is such that one sharp corner part is situated in an indentation of the one recess and another sharp corner part is situated in an indentation of the opposite recess. As a result thereof, the construction elements are securely connected to one another and are difficult to separate without removing the connecting means.

If the recess is formed by cutting away a part from said construction element and when this cut-out part forms the slidable part, then a dovetail-shaped cross section is also preferred as a dovetail-shaped cross section can be cut from a side face of a construction element in a simple manner. It is readily possible to saw, for example, dovetail-shaped recesses in wooden blocks, such as for example toy building blocks or parts of racks.

Preferably, the assembly is made of a compressible material. More particularly, the compressible material is plastic. It is readily possible to cut parts out of plastic. However, the present invention is not limited to plastic. Other compressible materials can also be used to make the assembly and not all construction elements of the assembly have to be made from the same material either.

Preferably, said assembly is configured to produce a spatial construction. If the construction elements are toy blocks, such spatial constructions are, for example, towers. However, the spatial construction may also be a rack, such as for example wine racks, shoe racks, etc. or the spatial construction may form part of a stand at a trade fair. The spatial construction may also be a wall or a floor. The advantage of a spatial construction composed of an assembly according to the invention is that it can be packaged in a compact way. The reason for this is that the construction elements which form the spatial construction do not have to be connected to one another in the packaging and the slidable parts which form the connecting means fit into the construction elements, as a result of which the assembly can be stacked in a compact manner. Transportation and storage are therefore no problem. In addition, such an assembly is very suitable for temporary constructions, such as spatial constructions for stand construction, because the construction can easily and quickly be erected and taken down.

The abovementioned object is also achieved by providing a method of connecting at least two construction elements which each comprise a number of side faces, in which each construction element comprises a recess and a part which is slidable into said recess and whose shape is virtually identical to the shape of the recess, and in which the method comprises fitting the slidable parts in the recesses in such a way that each slidable part extends in both recesses and in such a way that the slidable parts form a connecting means.

As has already been indicated when discussing the advantages of the assembly described above, such construction elements with recesses and slidable parts have various advantages. There is no need to provide for additional volume when packaging the construction elements. The reason for this is that the slidable parts which form the connecting means fit exactly into their respective recesses, as a result of which the construction elements can be stacked in a compact way. Also, the recesses which are not used to bring about a connection between two construction elements may comprise a slidable part which completely fits inside it in such a way that the recess is no longer visible and no dust can accumulate in said recess.

In a highly preferred embodiment, a part is cut out from at least one side face of each construction element in order to form a recess and said cut-out part forms the slidable part. Cutting a part out of the construction element and subsequently using said part as a connecting means has various advantages. Thus, there is no need to provide additional connecting means as the connecting means is already present in the construction means. Also, there is no need to provide for additional volume when packaging the construction elements. The reason for this is that the cut-out parts which form the connecting means fit exactly into their respective recesses, as a result of which the construction elements can be stacked in a compact manner. In addition, it is readily possible to ensure that the connecting means fits into the mutually opposite recesses of the construction elements to be connected. The term cut(ting) out includes all known ways of removing material, in which a residual part, a cut-out part, is obtained.

Furthermore preferably, the slidable parts have a virtually identical cross section in such a way that said recesses of construction elements adjoining one another are each other's mirror image, the recesses are virtually symmetrical with respect to an axis which extends virtually at right angles to the side face in which the recess is situated and, in order to fit the slidable parts in the recesses, said slidable parts are rotated through virtually 90° with respect to their position in the construction element before they were cut out. The space formed by the mutually opposite recesses of the construction elements to be connected thus has at least two planes of symmetry which extend at right angles to one another, i.e. the first plane of symmetry which is formed by the separation between the two recesses and a plane of symmetry which extends at right angles thereto. As a result thereof, the slidable parts also fit perfectly into said space when they have been rotated through 90° with respect to their position in the construction element before they were cut out and when they extend into both recesses of the connected construction elements. Due to the perfect fit and the fact that each slidable part extends both in the recess of the one construction element and is situated in the recess of the other construction element, a strong connection between the construction elements is achieved.

Preferably, each said recess ends in a side face which adjoins the side face in which the recess is formed and the slidable parts are pushed into the recesses. Laterally pushing in the slidable parts is simple and takes up little time. Each slidable part can be pushed individually into the mutually opposite recesses or slidable parts can be pushed simultaneously into the mutually opposite recesses. However, the construction element can also be pushed around the connecting means or connecting the two or more construction elements may be a combination of pushing the slidable parts into the recesses and pushing the construction elements around the connecting means.

Highly preferably, the at least two construction elements and the said connecting means are an assembly of at least two construction elements and a connecting means as described above.

The present invention is now explained in more detail by means of the following detailed description of a preferred embodiment of an assembly according to the present invention and a method of connecting two construction elements according to the present invention. The aim of this description is solely to give illustrative examples and to indicate further advantages and features of this assembly and this method and can therefore by no means be interpreted as a limitation of the area of application of the invention or of the patent rights defined in the claims.

BRIEF DESCRIPTION OF THE DRAWINGS

In this detailed description, reference numerals are used to refer to the attached drawings, in which.

DETAILED DESCRIPTION

In FIGS. 1 to 8, three possible embodiments of assemblies of construction elements (1) and connecting means (2) or parts thereof are illustrated. Obviously, the invention is not limited to these embodiments.

The construction elements (1) according to the first and the second embodiment of the invention are cube-shaped blocks of identical volume which serve as toy building blocks. Four of the eight side faces are provided with a central recess (3) which extends centrally in the side face along the entire length of the side face. This means that one end of each recess (3) ends in an adjoining side face, and the other end ends in another adjoining side face which runs parallel to the aforementioned adjoining side face.

Figure 8:
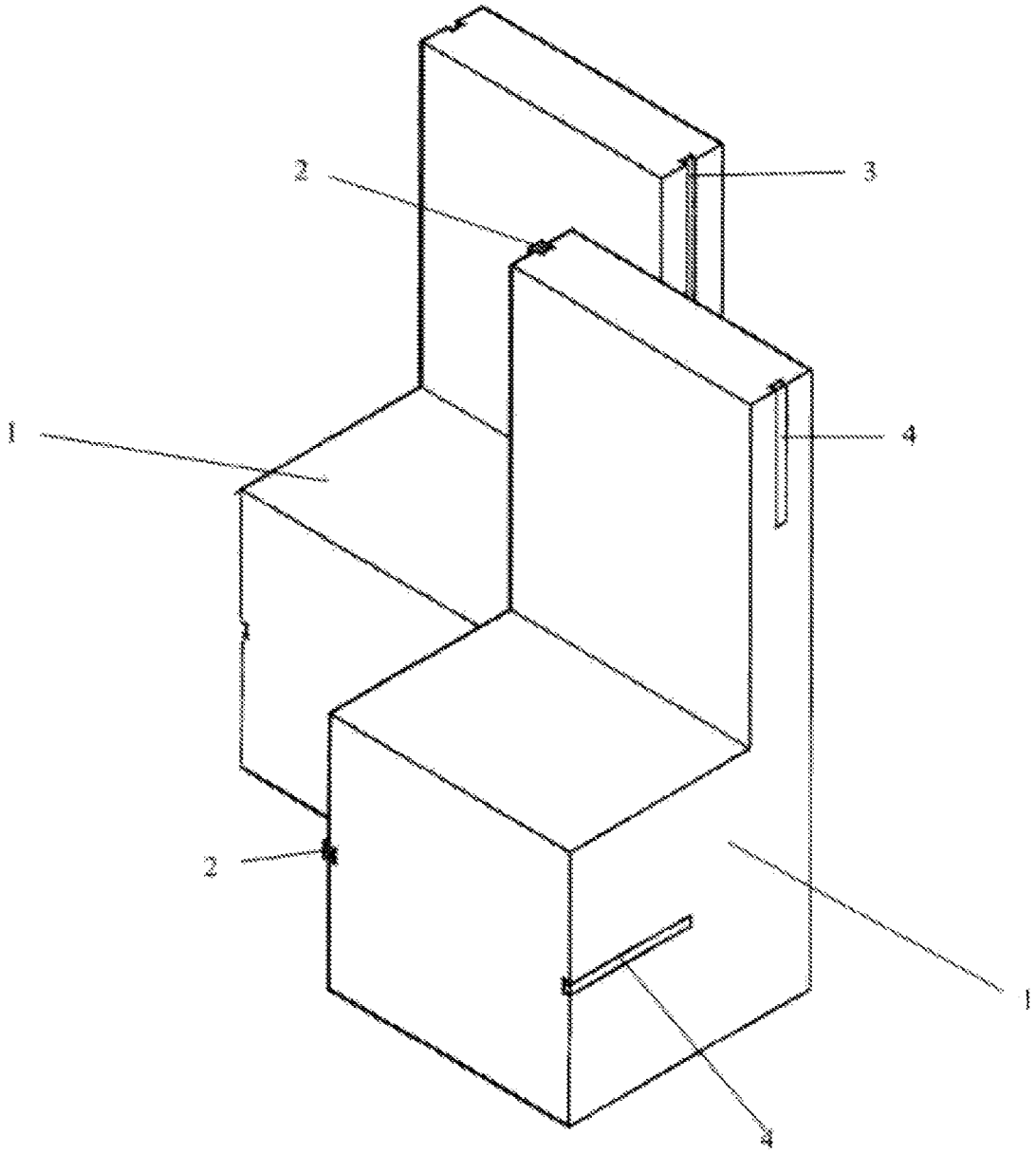
FIG. 8 shows a perspective view of construction elements according to a third embodiment of the invention while the construction elements are being connected to one another.

In FIG. 8, the construction elements (1) are L-shaped blocks. Such a construction element (1) may, for example, serve as a chair. The L-shaped side faces each comprise two recesses (3), one end of which ends in an adjoining side face.

All said recesses (3) in the side faces have been created by cutting away a part (4) from each side face. The recesses (3) are therefore in fact cutouts (3). Below, the recesses (3) are therefore also referred to by the term cutouts (3). A separate illustration of such a cut-out part (4) can be seen in FIG. 2. Each cut-out part (4) is slidable in its corresponding cutout (3), as a result of which a cut-out part (4) may also be referred to as a slidable part (4), but in the text below, it will always be referred to as a cut-out part (4). The cut-out part (4) in FIG. 2 has a flat side (7) which originally formed part of the side face from which it was cut and which has 3 sharp corner parts (6). The shape of the cut-out part (4) largely corresponds to the shape of the cutout (3). Thus, the corresponding cutout (3) has 3 indentations (5) which correspond to the 3 sharp corner parts (6) of the cut-out part (4). Such an indentation (5) can be seen in FIG. 6. The cut-out parts (4) may also have a different shape, such as a dovetail shape or the shape of an isosceles trapezium. The dovetail shape can be seen in FIGS. 1, 7 and 8. The cut-out parts (4) with a dovetail-shaped cross section have a flat side (7) which originally formed part of the side face from which it was cut and have 2 sharp corner parts (6). The corresponding cutouts (3) have two indentations (5). The cut-out parts (4) of the construction elements (1) are retained, as they are used to connect the two or more construction elements (1) to one another.

The thing that said cutouts (3) have in common is that the cross section of the cutouts (3) is symmetrical with respect to an axis of symmetry which extends at right angles to the side face in which the cutout (3) is situated. In both embodiments, virtually identical parts (4) are cut out of the construction elements (1) at the same position. As a result thereof, the cutouts (3) of two connected construction elements (1), at the location of the side faces of the adjoining side faces of the connected construction elements (1), are situated mutually opposite and virtually form two symmetrical halves of a space in which the connecting means (2) is fitted/fittable. The cutouts (3) are thus virtually each other's mirror image. The space has a first plane of symmetry which separates the two cutouts (3) from each other. As each cutout (3) is also symmetrical with respect to an axis of symmetry which extends at right angles to the side face in which the cutout (3) is situated, the space also has a second plane of symmetry which extends at right angles to the first plane of symmetry.

Figure 4:
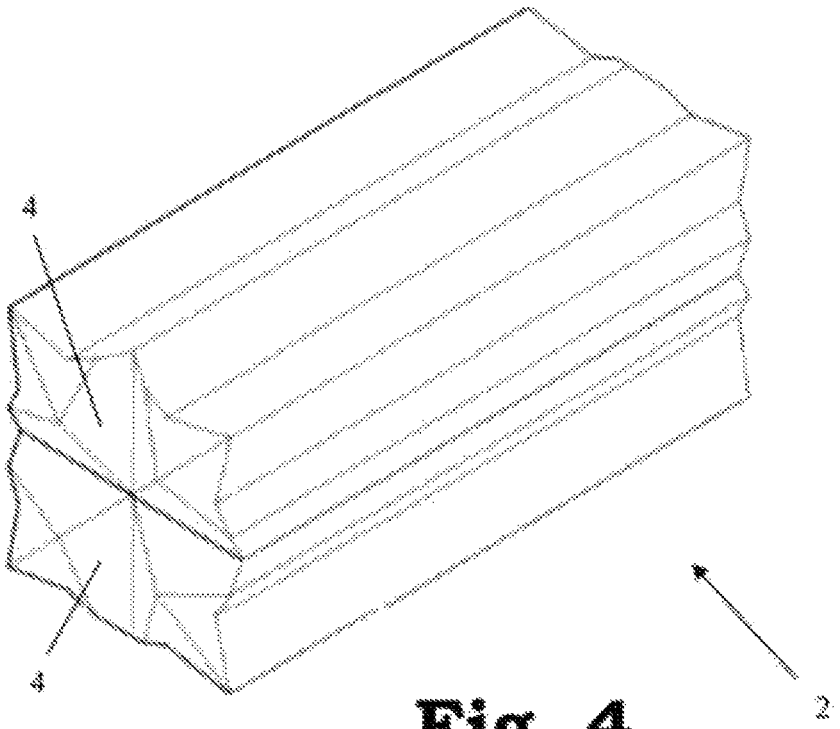
FIG. 4 shows a perspective view of a connecting means as illustrated in FIG. 3.
Figure 5:
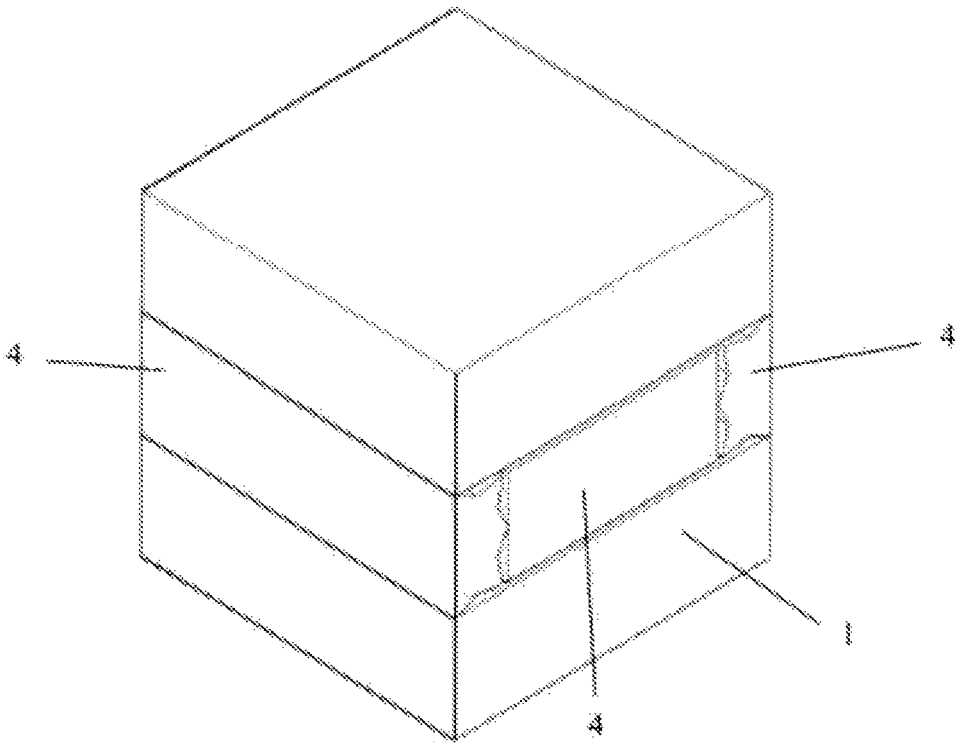
FIG. 5 shows a perspective view of a construction element according to the second embodiment of the invention.
Figure 6:
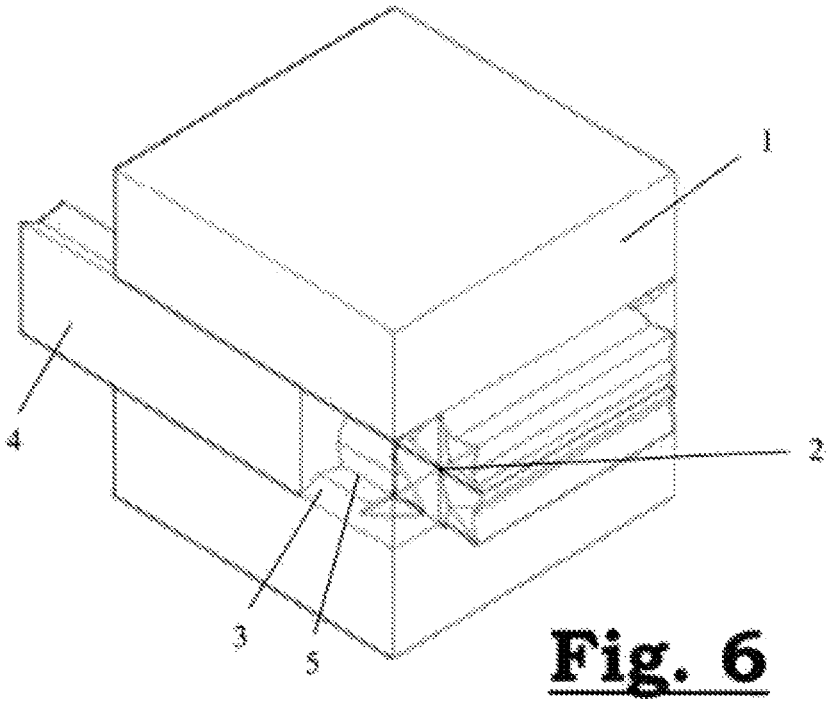
FIG. 6 shows a perspective view of a construction element according to the second embodiment of the invention, in which a connecting means is illustrated.

The cut-out parts (4) are identical and fit completely into their corresponding cutouts (3). Due to the symmetry of said space, the cut-out parts (4) also fit completely into the space when they are positioned transversely therein and serve as connecting means (2). The term transversely is understood to mean that one half of each cut-out part (4) is situated in one cutout (3) which partly forms the space and that the other half is situated in the other cutout (3) which partly forms the space. The cut-out parts (4) of two mutually opposite cutouts (3) of construction elements (1) are thus rotated through 90° and placed back into the space in order to bring about the connection between the two construction elements (1). Due to the symmetry of the space, the cross section of the connecting means (2) which is formed by the cut-out parts (4) thus also comprises two planes of symmetry which extend virtually at right angles to each other. Such a connecting means (2) is illustrated in FIG. 4.

Two cut-out parts (4) thus form a connecting means (2) which is able to connect two construction elements (1) to each other. The sharp corner parts (6) of the cut-out parts (4) which form the connecting means (2) engage in the indentations (5) of the cutouts (3). Due to these indentations (5) and corner parts (6), the connected construction elements (1) are securely connected to one another.

In the first and the second embodiment, each construction element (1) has 4 cutouts (3) with each construction element (1) being connectable to another construction element (1) via one cutout (3). As a result thereof, one construction element (1) can be connected to 4 other construction elements (1).

In the third embodiment, all L-shaped side faces of each construction element (1) have two cutouts (3). Each construction element (1) has two L-shaped side faces, as a result of which each construction element (1) is connectable to two other construction elements (1). The adjoining side faces of two construction elements (1) have two spaces in which a connecting means (2) is fittable. Here, each construction element (1) is connected to another construction element (1) via two connecting means (2), as a result of which the connection is of course strong. If the L-shaped blocks serve, for example, as seats, it is desirable not only for the bottom of the seats to be connected to one another, but also for the backrests to be connected to one another. This serves to prevent one backrest from leaning backwards more than another backrest.

In the first embodiment, the cutouts (3) of each construction element (1) do not adjoin one another. In the second embodiment, the cutouts (3) of a construction element (1) do adjoin one another and extend around the construction element (1). In the second embodiment, the construction is such that if a construction element (1) is connected to several construction elements (1) via its side faces, the connecting means (2) of the adjoining side faces of the construction element (1) come to lie against each other. In order to ensure that the connecting means (2) of the various side faces do not counteract each other, the ends of the connecting means (2)

are adapted in such a manner that the edges of the connecting means (2) can engage with each other more securely, as is shown in FIG. 4.

Below follows a detailed explanation of the way in which the connection between two or more construction elements (1) is brought about.

First, a cutout (3) is made in the construction elements (1). After the cutout (3) has been produced, the cut-out part (4) is still situated completely in the construction element (1) in which the cutout (3) has been made.

The cut-out parts (4) are pushed out of the cutouts (3). Subsequently, the cut-out parts (4) are rotated through 90° and transversely positioned in the cutout (3).

Positioning the cut-out parts (4) transversely in the cutouts (3) may be effected in several ways. Thus, it is possible to place the construction elements (1) to be connected against one another, so that their position with respect to one another corresponds to the position with respect to one another which they will have when they are connected. Due to this positioning, the cutouts (3) of the construction elements (1) to be connected are situated opposite one another and form a space. In this space, the cut-out parts (4) are then pushed into this space, optionally simultaneously.

Another possibility is first to push the cut-out parts (4) in a cutout (3) of a first construction element (1) and then to push a second construction element (1) around the part of the cut-out parts (4) which projects with respect to the first construction element (1).

Transversely positioning the cut-out parts (4) may also be effected by a combination of the above ways.

As long as the connecting means (2) is situated in said space, it is difficult to separate the connected construction elements (1) from each other and the connection between the connected construction elements (1) is able to absorb forces well.

Such assemblies are very suitable for producing spatial constructions, as it is possible to produce (large) spatial constructions without encountering transportation problems. The reason for this is that the construction elements (1) can be packed in a very compact way, as they can be packed separately from each other and as the cut-out parts (4) which form the connecting means (2) fit exactly into the construction elements (1) and do not take up additional space.

They are also highly suitable for temporary spatial constructions, for example for building stands at trade fairs, temporary furniture and furniture which is moved frequently. The reason for this is that the construction elements (1) are readily and quickly connectable to produce a spatial construction and can also be disassembled quickly. All that has to be done in order to connect the construction elements (1) to one another is to push the connecting means (2) into the cutouts (3). All that has to be done to release the connection is to push the connecting means (2) back out of the cutouts (3).

Figure 1:
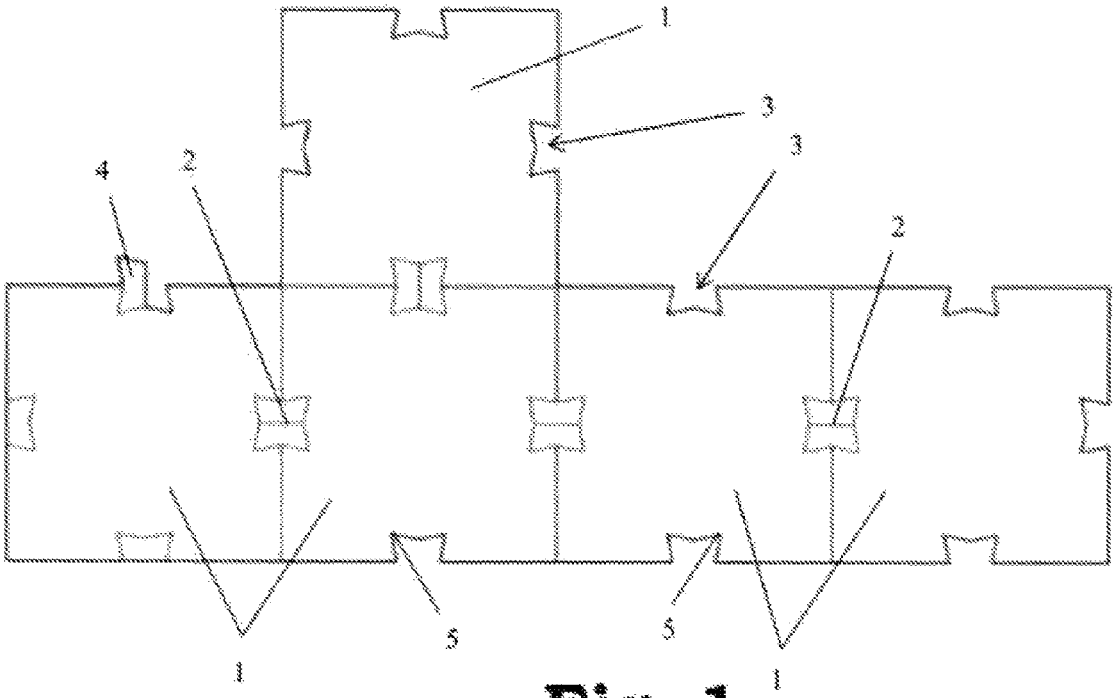
FIG. 1 shows a front view of some connected construction elements according to a first embodiment of the invention.
Figure 2:
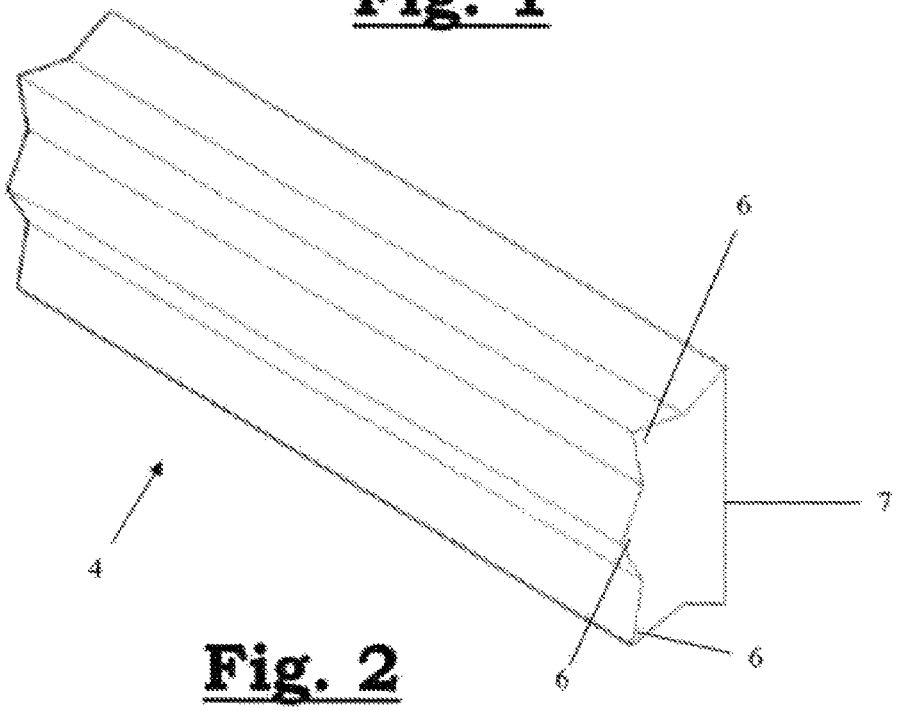
FIG. 2 shows a perspective view of a slidable part according to a second embodiment of the invention.
Figure 3:
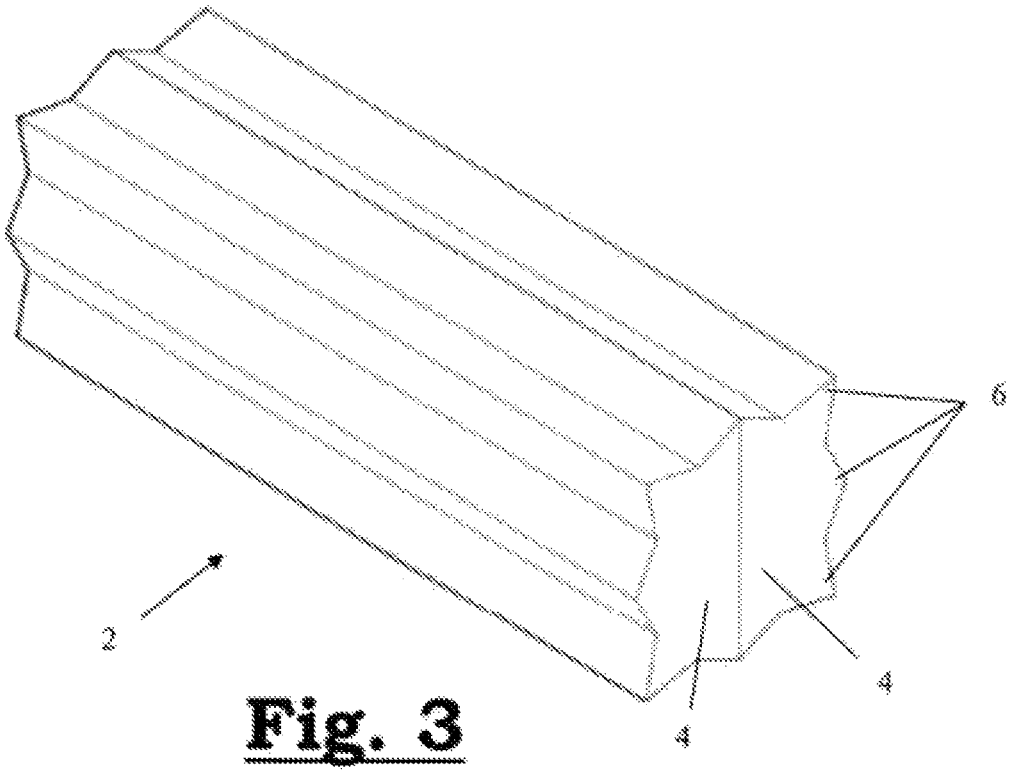
FIG. 3 shows a perspective view of a connecting means according to the second embodiment of the invention.
Figure 7:
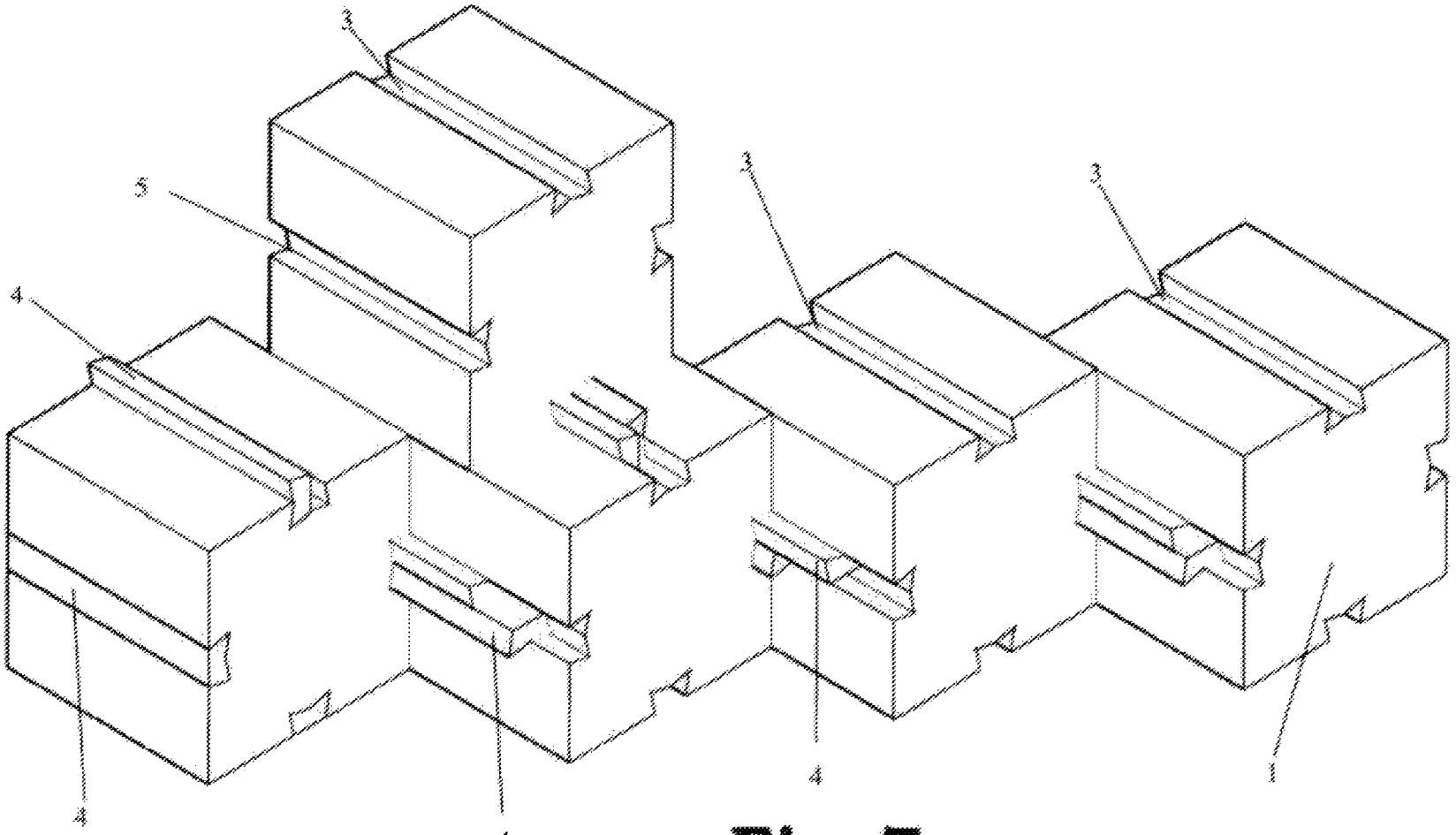
FIG. 7 shows a perspective view of some construction elements according to a first embodiment of the invention while the construction elements are being connected to one another.

FIGS. 1, 7 and 8 show that the cutouts (3) which are not used to bring about a connection with another construction element (1) can be filled with one cut-out part (4). Such cutouts (3) are thus hidden from view and can thus not collect any dust. However, they still remain available if it is subsequently desired to bring about a connection with another construction element. In this way, it is also not necessary to provide any additional storage space for a connecting means which might possibly be needed later, as that is already present.

The invention claimed is:

1. Assembly of at least two construction elements (1), each construction element comprising:

a number of side faces and at least one connecting means (2) for connecting the construction elements (1) to one another, wherein at least one side face of each construction element (1) comprises a recess (3) and a part (4) is slidable in said recess (3) and a shape of the part is virtually identical to a shape of the recess (3), further wherein said connecting means (2) is formed by at least a pair of the slidable parts (4) of two different side faces.

2. Assembly according to claim 1, wherein the recess (3) is formed by cutting away a part (4) from said construction element (1), and in that said cut-out part (4) forms the slidable part (4).

3. Assembly according to claim 1, wherein said recess (3) ends in a side face, adjoining the side face which comprises said recess (3).

4. Assembly according to claim 3, wherein the recess (3) extends over an entire height of the side face.

5. Assembly according to claim 1, wherein the recesses (3) comprise indentations (5) with which the connecting means (2) engages.

6. Assembly according to claim 1, wherein, in a connected position of the construction elements (1), the recesses (3) of connected side faces of the construction elements (1) are mutually opposite and in that each slidable part (4) extends in the recesses (3) of the connected side faces.

7. Assembly according to claim 6, wherein each recess (3) is substantially symmetrical with respect to an axis which extends at right angles to the side face in which said recess (3) is situated, and in that, in the connected position of the construction elements (1), the mutually opposite recesses (3) are virtually each other's mirror image.

8. Assembly according to claim 1, wherein the slidable parts (4) have a dovetail-shaped cross section.

9. Assembly according to claim 1, wherein the assembly is made of a compressible material.

10. Assembly according to claim 1, wherein said assembly is configured to produce a spatial construction.

11. Method of connecting at least two construction elements (1) each comprising a number of side faces, wherein each construction element (1) comprises:

a recess (3) and a part (4) slidable into said recess (3) and having a shape virtually identical to a shape of the recess (3), and wherein the method comprises:

fitting at least one pair of the slidable parts (4) in the recesses (3) such that each slidable part (4) extends in both recesses (3) of adjacent construction elements, and such that the at least one pair of slidable parts (4) form a connecting means (2).

12. Method according to claim 11, wherein a part (4) is cut out from at least one side face of each construction element (1) in order to form a recess (3) and said cut-out part (4) forms the slidable part (4).

13. Method according to claim 12, wherein the slidable parts (4) have a virtually identical cross section in such a way that said recesses (3) of construction elements (1) adjoining one another are each other's mirror image, in that the recesses (3) are virtually symmetrical with respect to an axis which extends virtually at right angles to the side face in which the recess (3) is situated, and in that, in order to fit the slidable parts (4) in the recesses (3), said slidable parts (4) are rotated through virtually 90° with respect to their position in the construction element (1) before they were cut out.

14. Method according to claim 11, wherein each said recess (3) ends in a side face which adjoins the side face in which the recess (3) is formed, and in that the slidable parts (4) are pushed into the recesses (3).

15. Method according to claim 11, wherein the at least two construction elements (1) and the said connecting means (2) are an assembly of at least two construction elements (1) and a connecting means (2).

* * * * *